US009524839B2

(12) United States Patent
Kuo

(10) Patent No.: US 9,524,839 B2
(45) Date of Patent: Dec. 20, 2016

(54) SWITCH ASSEMBLY

(71) Applicant: Excel Cell Electronic Co., Ltd., Taichung (TW)

(72) Inventor: Ming-Chang Kuo, Taichung (TW)

(73) Assignee: Excel Cell Electronic Co., Ltd., Taichung (TW)

( * ) Notice: Subject to any disclaimer, the term of this patent is extended or adjusted under 35 U.S.C. 154(b) by 0 days.

(21) Appl. No.: 14/988,901

(22) Filed: Jan. 6, 2016

(65) Prior Publication Data

US 2016/0217955 A1 Jul. 28, 2016

(30) Foreign Application Priority Data

Jan. 23, 2015 (TW) ..... 104102356 A

(51) Int. Cl.
*H01H 50/44* (2006.01)
*H01H 50/02* (2006.01)
*H01H 50/14* (2006.01)

(52) U.S. Cl.
CPC ..... *H01H 50/44* (2013.01); *H01H 50/02* (2013.01); *H01H 50/14* (2013.01)

(58) Field of Classification Search
CPC ..... H01H 50/44; H01H 50/14; H01H 50/02; H01H 9/24; H01H 50/24; H01H 50/641; H01H 50/647
See application file for complete search history.

(56) References Cited

U.S. PATENT DOCUMENTS 6,545,575 B1 * 4/2003 Hirabayashi ..... H01H 50/042 335/128
8,258,901 B2 * 9/2012 Hao ..... H01H 51/08 335/132
8,692,633 B2 * 4/2014 Naruo ..... H01H 13/568 200/524
9,437,375 B2 * 9/2016 Kuo ..... H01H 9/24

* cited by examiner

*Primary Examiner* — Bernard Rojas
(74) *Attorney, Agent, or Firm* — Trop Pruner & Hu, P.C.

(57) ABSTRACT

A switch assembly includes a switch unit having first and second conductive plates, and a switch control unit having a sliding member and a locking member. The sliding member has a closed cycle guide groove, and the locking member has a locking portion to slide in the guide groove. When the locking portion is engaged in a first locking site of the guide groove, the first and second conductive plates are stabilized in their electrically disconnected state. When the locking portion is engaged in a second locking site of the guide groove, the first and second conductive plates are stabilized in their electrically connected state.

15 Claims, 13 Drawing Sheets

SWITCH ASSEMBLY

CROSS-REFERENCE TO RELATED APPLICATION

This application claims priority to Taiwanese Application No. 104102356, filed on Jan. 23, 2015.

FIELD

The disclosure relates to a switch assembly, and more particularly to a switch assembly operable to be mechanically positioned between a circuit making position and a circuit breaking position.

BACKGROUND

As shown in FIGS. 1 and 2, a conventional electrical magnetic switch includes an iron core 11, a coil 12 wound around the iron core 11, and an armature 13 detachably connected to the iron core 11. When the coil 12 is energized, an electrical current passes through the coil 12 so that the iron core 11 is magnetized to produce an electromagnetic effect. The armature 13 is magnetically attracted by the iron core 61 to be at a circuit-making position (as shown in FIG. 1), thereby forming a circuit with a relatively large electrical current flowing therethrough. When the coil 12 is de-energized, the electromagnetic effect of the iron core 11 disappears, and the armature 13 is placed at a circuit-breaking position (as shown in FIG. 2) to break the circuit. However, in order to maintain the circuit making position, the coil 62 has to be constantly energized. As a result, a hazard to use the conventional electrical magnetic switch may arise.

Referring to FIG. 3, a heart-shaped guide groove of a switch control unit provided in an electromagnetic relay assembly disclosed in Taiwanese Patent No. M485492 (a basic Taiwanese patent of a co-pending U.S. application of the applicant, i.e., U.S. patent application Ser. No. 14/665,152 filed on Mar. 23, 2015) is shown. The electromagnetic relay assembly has a switching unit controlled by the switch control unit, which is connected to an electromagnetic unit. The electromagnetic unit operates the switching unit through the switch control unit, and the switch control unit is able to lock the switching unit at a circuit-making and circuit-breaking position. Therefore, a need to constantly energize a coil of the electromagnetic unit for maintaining a circuit-making position of the switching unit may be dispensed with. The switch control unit has the heart-shaped guide groove 14 that is symmetrical to a reference axis (L1), and a locking member (not shown) inserted into the guide groove. The guide groove 14 enables a locking member (not shown) to slide cyclically therein in a counterclockwise direction and to be positioned at a lower first locking position 141 and a higher second locking position 142. The locking member slides from the first locking position 141 to the second locking position 142 and thereafter from the second locking position 142 to the first locking position 141 by consecutively passing through a first ramp 151, a first step 161, a second step 162, the second locking position 142, a third step 163, a second ramp 152 and a fourth step 164 for returning back to the first locking position 141. A gradient of the depth of the guide groove 14 is shown in FIG. 4. If each of the first, second, third, and fourth steps has a height of 0.2 millimeters along a direction of the depth of the guide groove 14, a largest depth gradient of the guide groove 14 is 0.6 millimeters. Because the guide groove 14 has a large depth gradient for the locking member to ascend and descend, not only does a greater kinetic energy be required to actuate the locking member to ascend in the guide groove 14 during the switching of the switch unit, but also the service life of the locking member may be reduced by impaction between the guide groove 14 and the locking member.

SUMMARY

Therefore, an object of the disclosure is to provide a switch assembly that may alleviate the drawbacks described hereinbefore. According to the disclosure, the switch assembly includes a housing, an actuator, a switch control unit, and a switch unit.

The actuator is mounted to the housing.

The switch control unit includes a carrier, a sliding member, and a locking member. The carrier is mounted on the housing in proximity to the actuator. The sliding member is slidably inserted into the carrier and actuated by the actuator. The sliding member has a guide groove that forms a closed cycle path and that has a first locking site, a second locking site, a plurality of ramps, and a plurality of steps. The first locking site is situated between one of the steps and one of the ramps adjacent to the one of the steps. The second locking site is situated between another one of the steps and another one of the ramps adjacent to the another one of the steps. The locking member has a pivot portion, which is pivotally connected to the carrier, and a locking portion which is inserted into the guide groove and which is movable along the closed cycle path and between the first and second locking sites.

The switch unit includes a spring-loaded module, a first conductive plate, and a second conductive plate. The spring-loaded module is disposed in abutment with the sliding member. The first conductive plate is connected to the spring-loaded module. The second conductive plate is spaced apart from the first conductive plate.

The actuator actuates the sliding member to move relative to the carrier between a first position and a second position.

When the sliding member is moved to the first position, the locking portion of the locking member is placed in the first locking site, and the spring-loaded module urges the locking portion to engage the first locking site, and at the same time moves away from the second conductive plate so that the first and second conductive plates are electrically disconnected.

When the sliding member is moved to the second position, the locking portion of the locking member is placed in the second locking site, and the spring-loaded module urges the locking portion to engage in the second locking site, and at the same time moves to the second conductive plate so that the first and second conductive plates are electrically connected with each other.

BRIEF DESCRIPTION OF THE DRAWINGS

Other features and advantages of the disclosure will become apparent in the following detailed description of the embodiment with reference to the accompanying drawings, of which.

DETAILED DESCRIPTION

Figure 5:
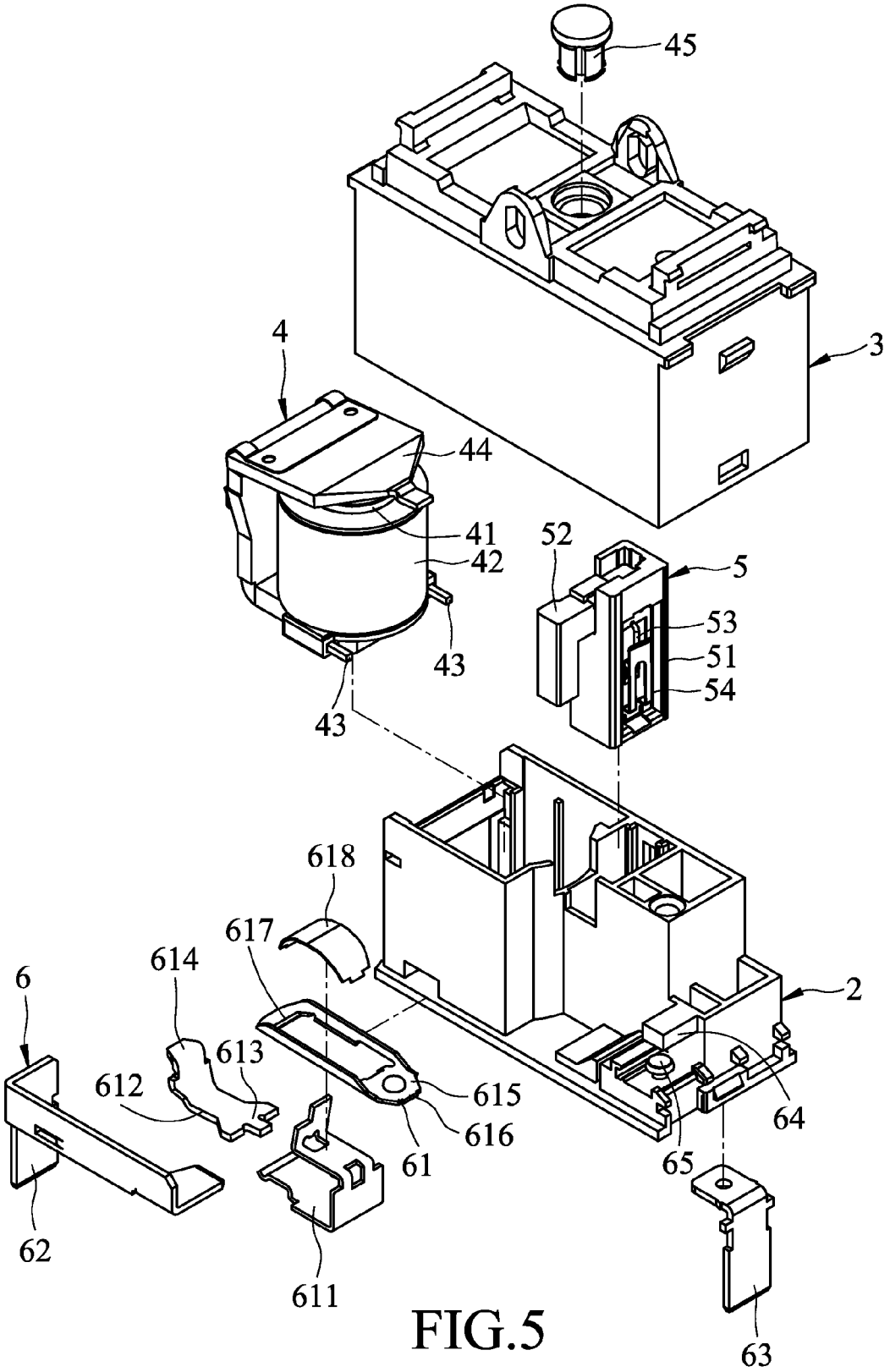
FIG. 5 is an exploded perspective view of an embodiment of a switch assembly according to the present disclosure.
Figure 6:
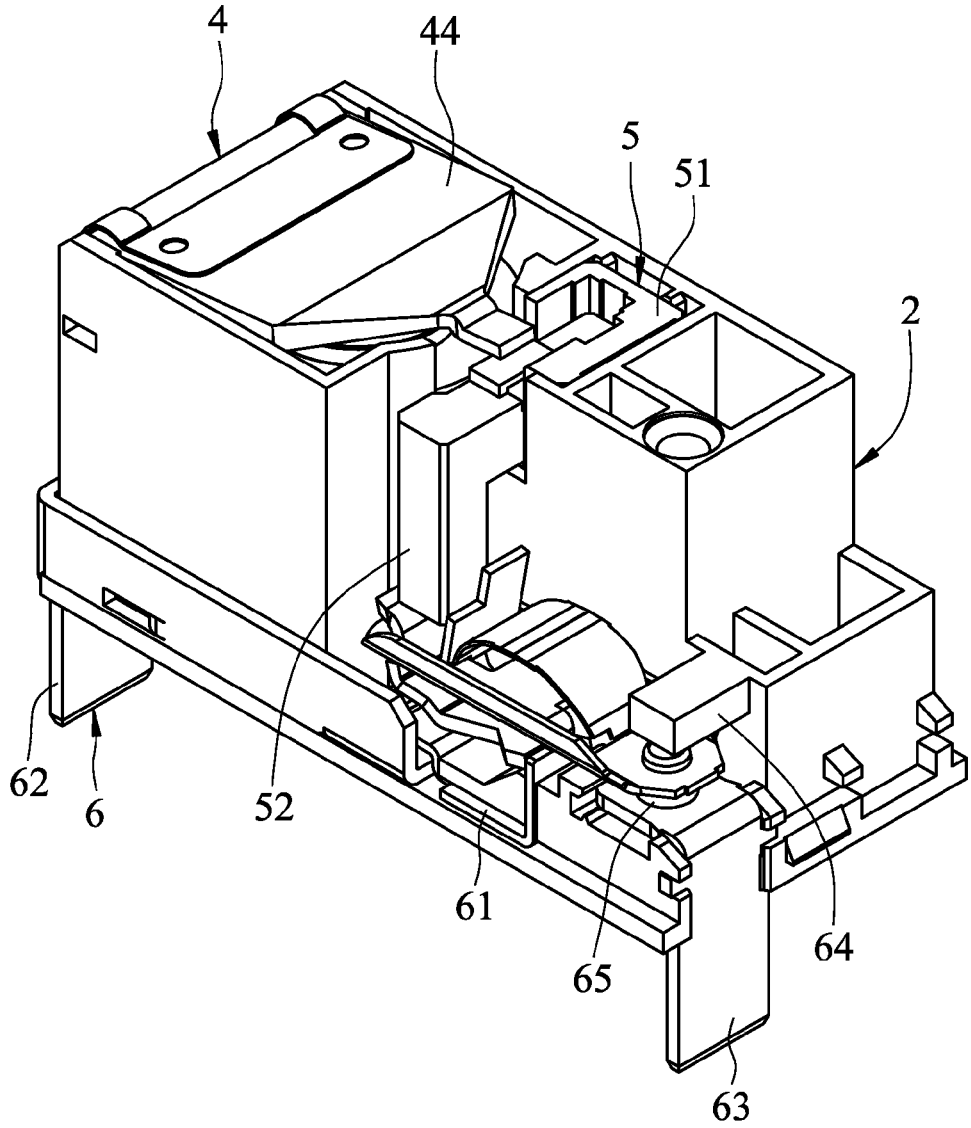
FIG. 6 is a partially assembled perspective view of the embodiment.
Figure 7:
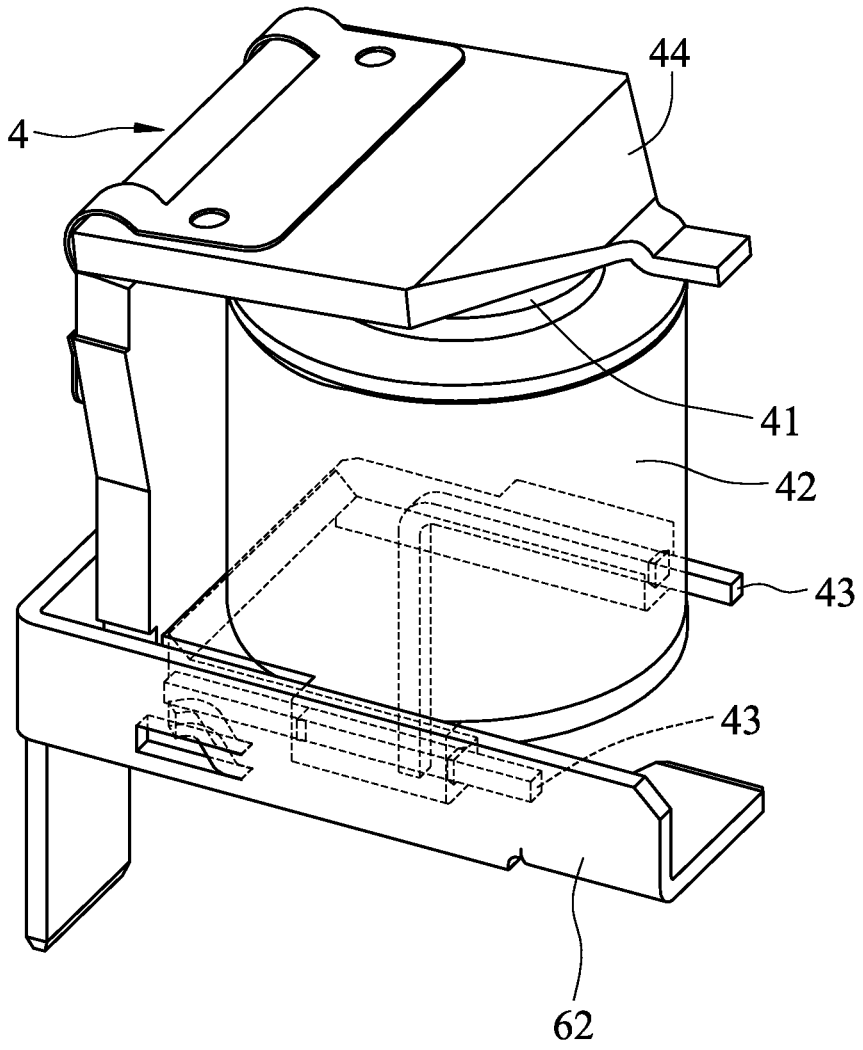
FIG. 7 is a partially assembled perspective view illustrating an electrical connection between an actuator and a first conductive plate of the embodiment.

Referring to FIGS. 5 to 7, an embodiment of a switch assembly according to the disclosure is illustrated. The switch assembly includes a housing, an actuator 4, a switch control unit 5, and a switch unit 6.

The housing includes a mounted seat 2 and a cover 3 detachably covering the mount seat 2.

Figure 12:
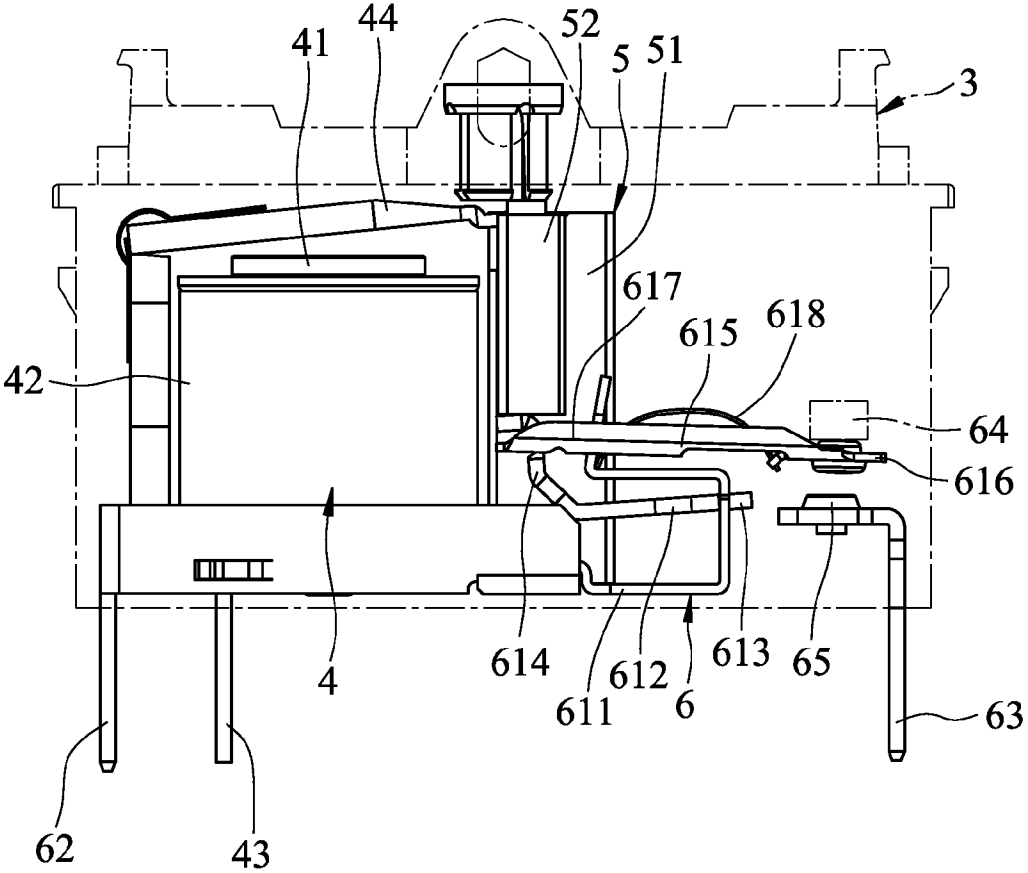
FIG. 12 is a side view of the embodiment illustrating the switch control unit and the switch unit when the locking member is in a first locking site.
Figure 16:
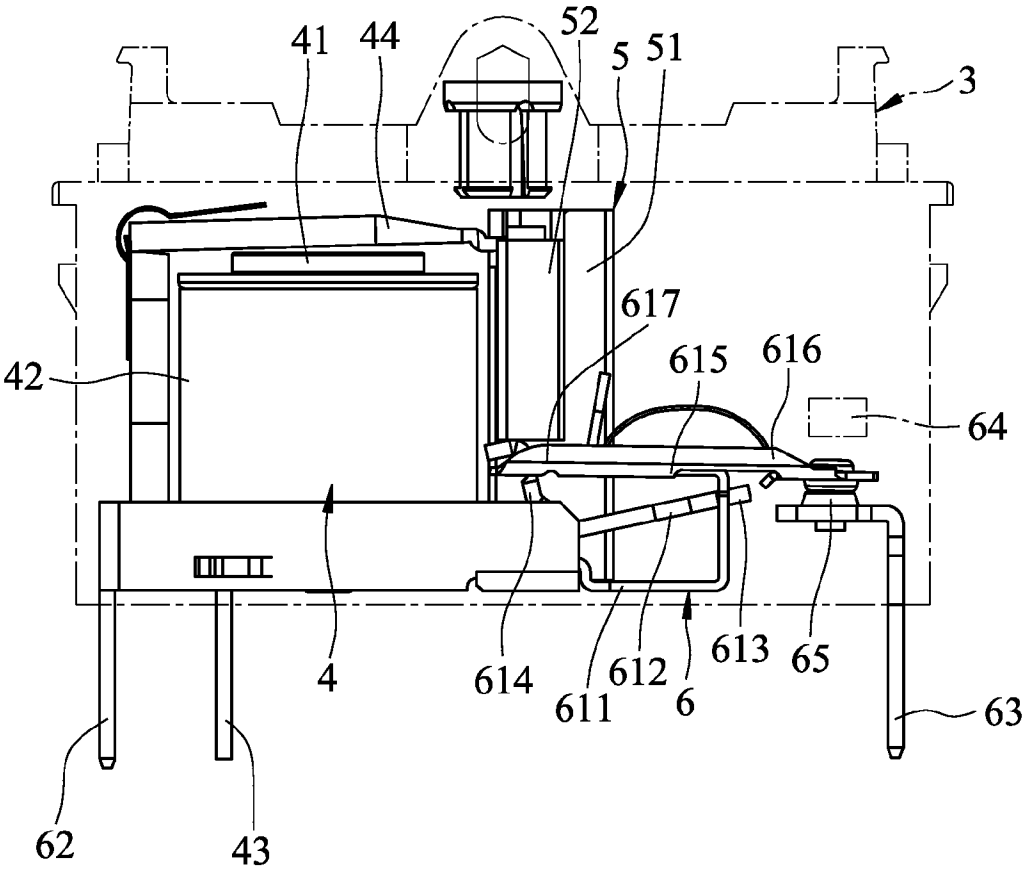
FIG. 16 is a side view t illustrating the switch unit and the switch control unit when the locking member is at a position between the first and second locking sites.

The actuator 4 is mounted to the mount seat 2 and includes a magnetic spool 41, a coil 42 wound on the magnetic spool 41, two terminals 43 electrically coupled to the coil 42 for receiving a current signal, a magnetic member 44 pivotally disposed on the mount seat 2 and confronting with the magnetic spool 41, and a press member 45 disposed in contact with the magnetic member 44 and partially extending outward through the cover 3 (see FIGS. 12, 14 and 16) so as to be operated through a manual pressing operation. When the coil 42 is energized, the magnetic spool 41 is excited to generate a magnetic attraction force for the magnetic member 44 to move upward or downward. When the coil 42 is not connected to a power supply (not shown), the press member 45 may be manually pressed or unpressed to produce a movement of the magnetic member 44, without operating the coil 42.

Referring to FIGS. 5, and 9 to 11, the switch control unit 5 is detachably inserted into the mount seat 2 in a direction parallel with a direction of insertion of the spool 41 into the mount seat 2. The switch control unit 5 includes a carrier 51, a sliding member 52, a locking member 53 and a retaining plate 54.

In this embodiment, the carrier 51 is detachably mounted to the mount seat 2 in proximity to the actuator 4.

Figure 9:
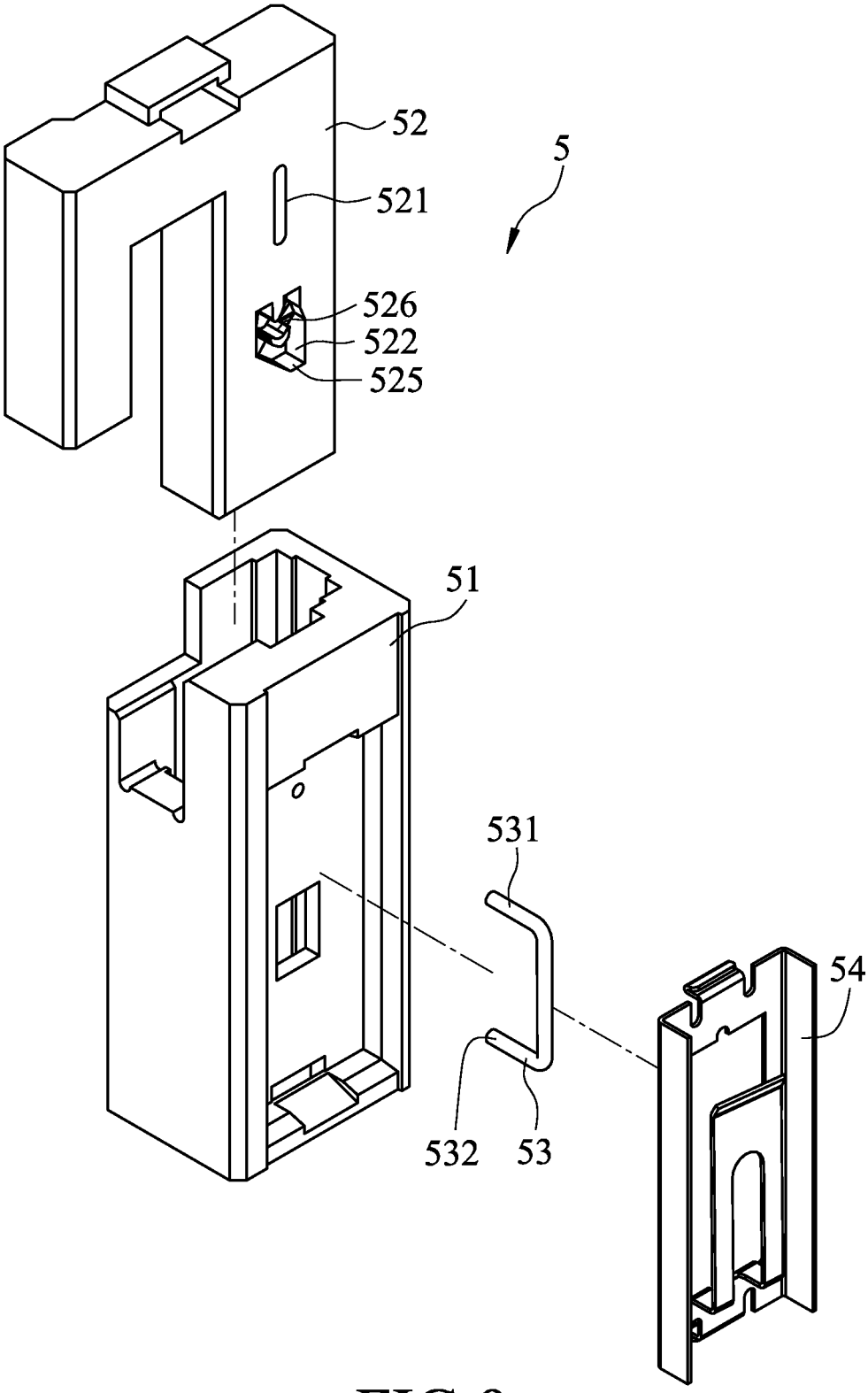
FIG. 9 is a perspective view of a switch control unit of the embodiment of FIG. 5.

As shown in FIGS. 5 and 9, the sliding member 52 is slidably inserted into the carrier 51 and actuated by the actuator 4. In this embodiment, the sliding member 52 has a guide groove 522 that forms a closed cycle path, and an elongate opening 521 that is spaced apart from the guide groove 522. In addition, the sliding member 52 may be made of an insulating plastic material to avoid a short circuit or an electrical discharge caused by friction during operation. However, the material of the sliding member 52 is not limited to this disclosure.

Figure 10:
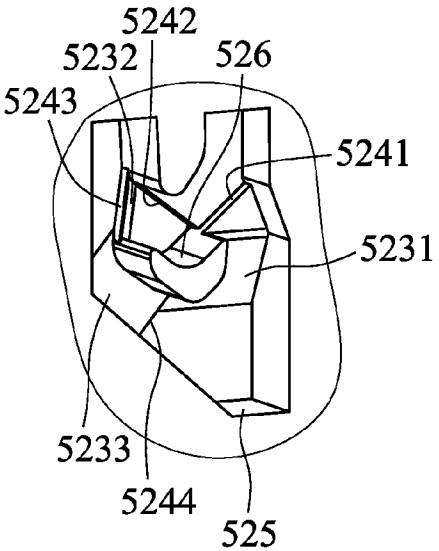
FIG. 10 is a fragmentary perspective view of a guide groove of the embodiment of FIG. 5.

As shown in FIG. 10, the guide groove 522 has a first locking site 525, a second locking site 526, a plurality of ramps 523 (specifically, 5231, 5232, 5233), and a plurality of steps 524 (specifically, 5241, 5242, 5243, 5244). The first locking site 525 is situated between one of the steps 524, (specifically, the step 5244 and one of the ramps 523, specifically, the ramp 5231. The second locking site 526 is situated between another one of the steps 524, specifically, the step 5242, another one of the ramps 523, specifically, the ramp 5232. In this embodiment, the guide groove 522 has a profile substantially conforming to a heart shape. The first and second locking sites 525, 526 are aligned with each other along an axis of symmetry of the guide groove 522. The first and second locking sites 525, 526 are equal in depth and are as deep as a bottom end of the guide groove 522. A height of each of the steps 524 is 0.2 millimeters along a direction of the depth of the guide groove 522. However, the height of each step 524 is not limited to this disclosure. In addition, the guide groove 522 may be configured to have any other shape, such as, a lightning shape, or a triangle shape.

Figure 1:
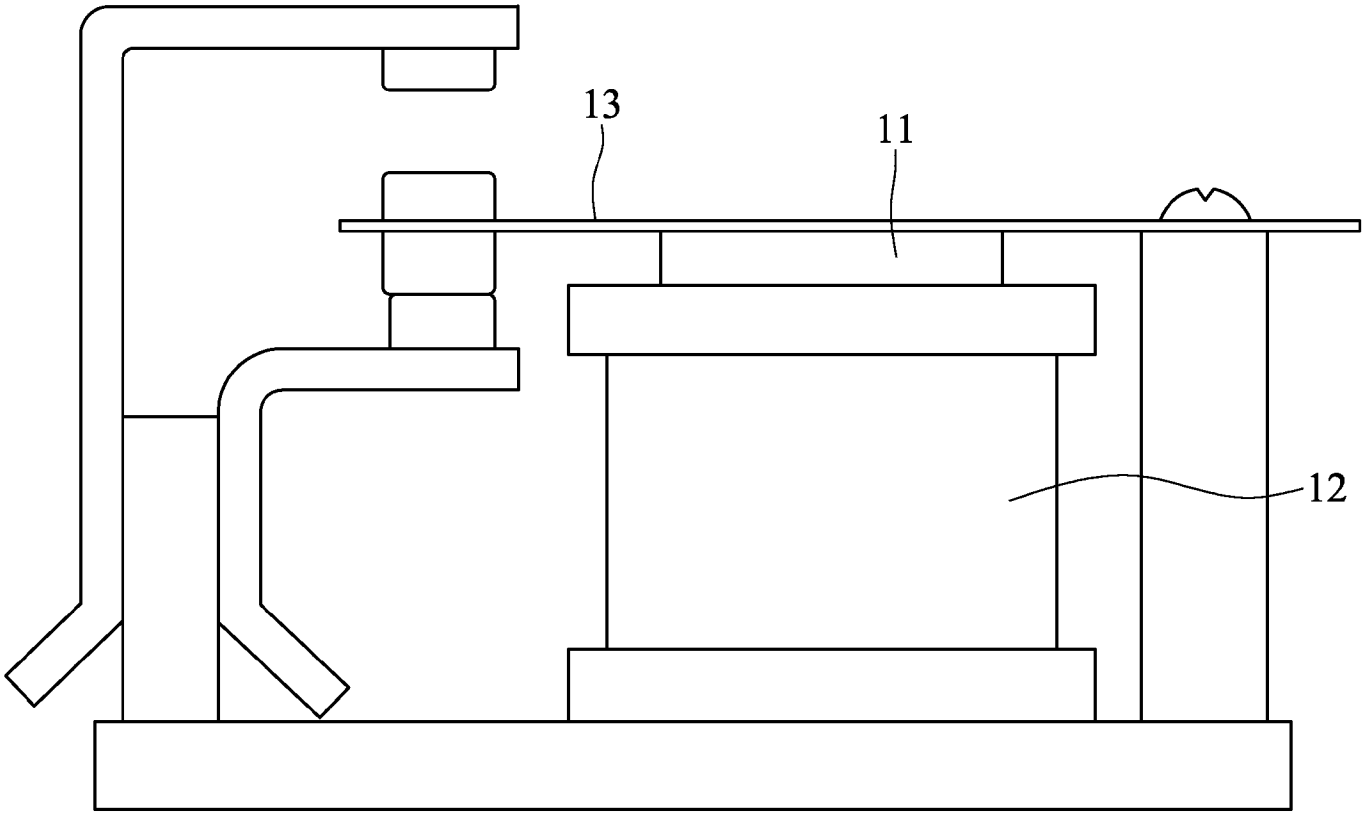
FIG.1 PRIOR ART
FIG. 1 is a side view of a conventional relay assembly in an energized state.
Figure 2:
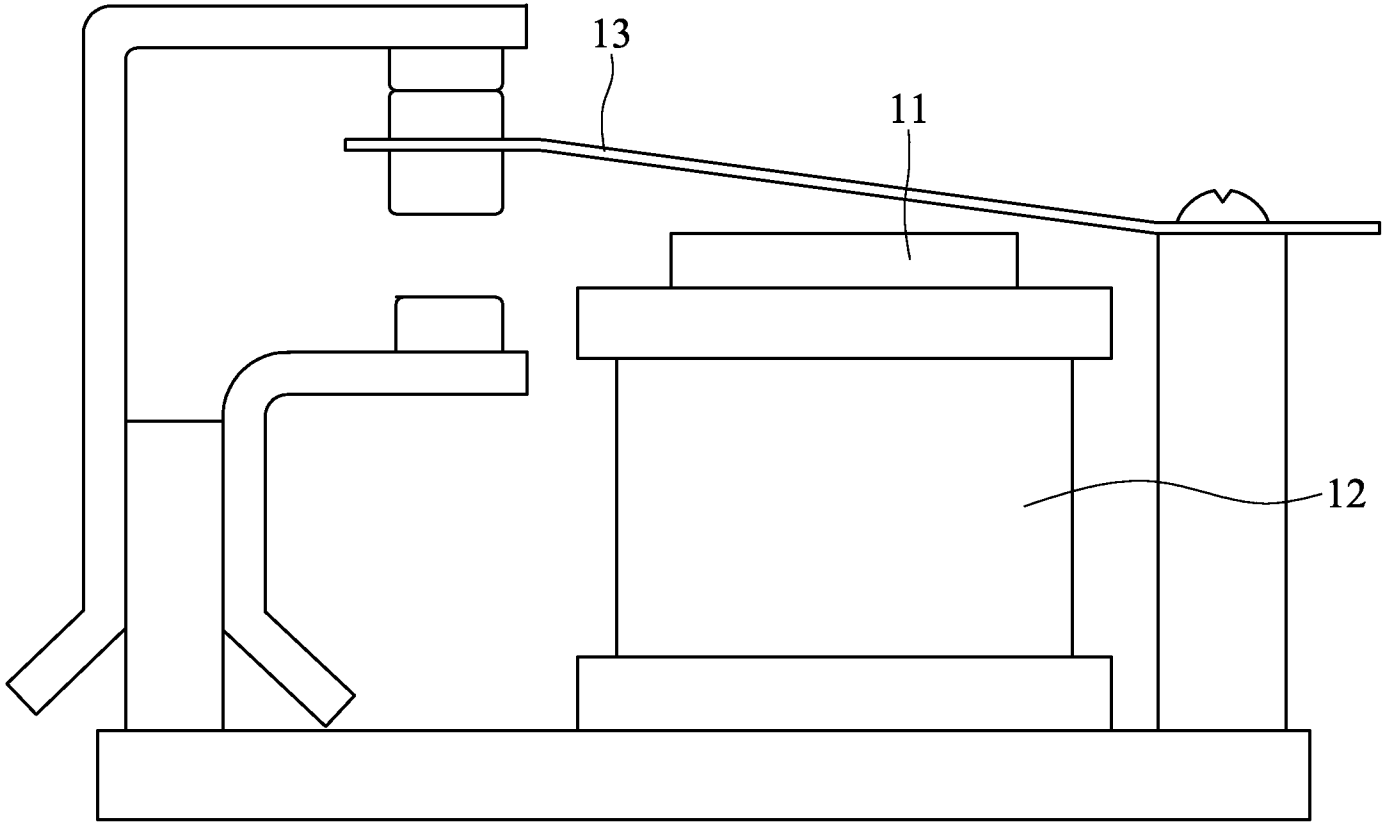
FIG.2 PRIOR ART
FIG. 2 is a side view of the conventional relay assembly in a de-energized state.
Figure 4:
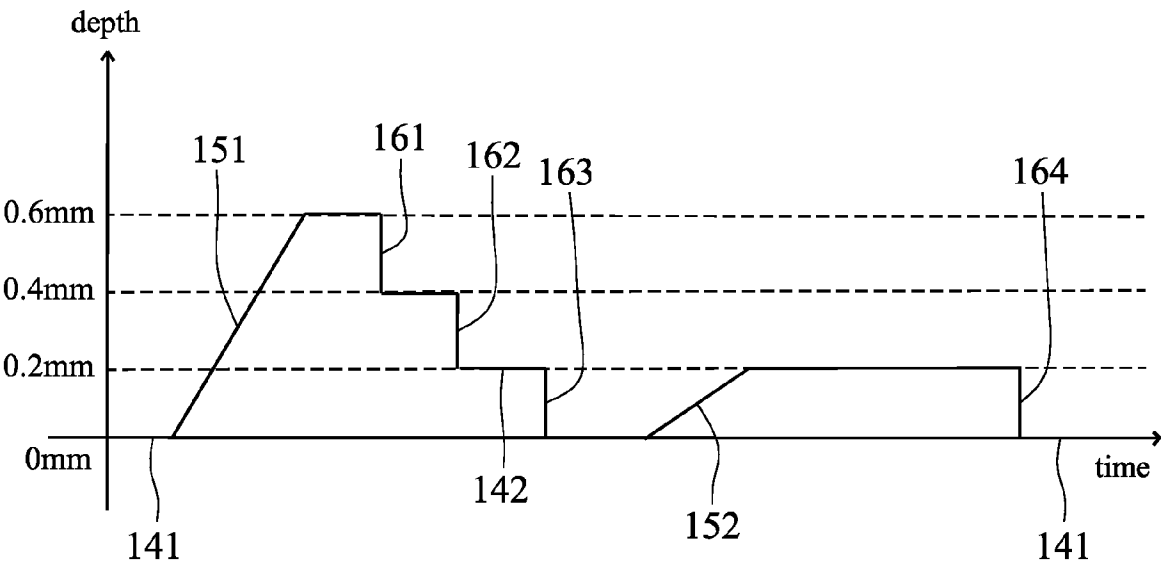
FIG.4 PRIOR ART
FIG. 4 is a graphic diagram illustrating a depth gradient of the closed cycle path of the guide groove of FIG. 3, along which a locking member of the electromagnetic relay assembly travels.
Figure 3:
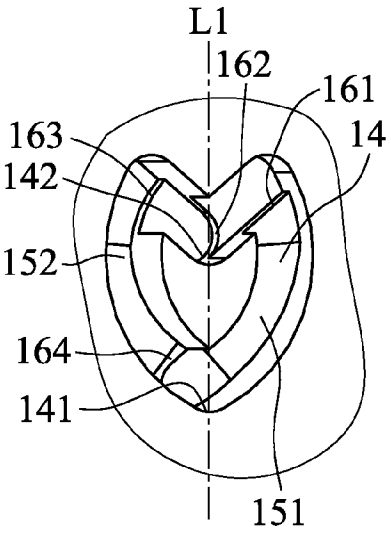
FIG.3 PRIOR ART
FIG. 3 is a fragmentary perspective view of a guide groove of an electromagnetic relay assembly as disclosed in Taiwanese Patent No. M485492.
Figure 11:
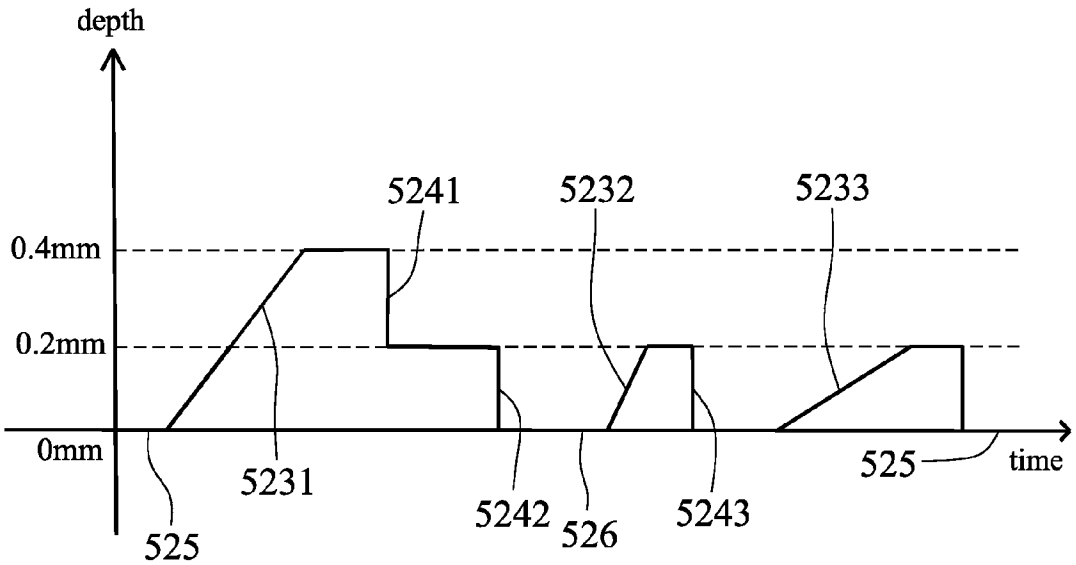
FIG. 11 is a graphic diagram illustrating a depth gradient of the closed cycle path in the guide groove of FIG. 10, along which a locking member of the embodiment travels.

The locking member 53 has a pivot portion 531 which is pivotally connected to the carrier 51, and a locking portion 532 which is inserted into the guide groove 522 and which is movable along the closed cycle path of the guide groove 522 to displace between the first and second locking sites 525, 526. When the locking portion 532 within the guide groove 522 moves to one of the first and second locking sites 525, 526, the step 5242, or 5244 is able to limit the reverse movement of the locking portion 532. By virtue of the ramps 523, the locking portion 532 is enabled to move to the next one of the steps 524. In this embodiment, the locking portion 532 consecutively passes through a first one of the ramps 523, (i.e., 5231), a first one of the steps 524 (i.e., 5241), and a second one of the steps 524, (i.e., 5242) when sliding from the first locking site 525 to the second locking site 526, and passes through a second one of the ramps 523 (i.e., 5232), a third one of the steps 523 (i.e., 5243), a third one of the ramps 523 (i.e., 5233), and a fourth one of the steps 524 (i.e., 5244) when sliding from the second locking site 526 to the first locking site 525. FIG. 11 illustrates a depth gradient of the guide groove 522. Compared with the guide groove of the electromagnetic relay assembly shown in FIGS. 3 and 4, the depth gradient of the guide groove 522 may be reduced to two-thirds (⅔) of that of the electromagnetic relay assembly. Specifically, the deepest depth of the guide groove 522 is only 0.4 millimeters, thereby reducing the impaction between the locking portion 532 and the guide groove 522.

In comparison of the electromagnetic relay assembly, the depth gradient of the guide groove 522 is smaller, and a smaller kinetic energy is needed for the locking portion 532 to slide in the guide groove 522. Further, since the impaction between the locking portion 532 and the guide groove 522 is reduced, the service life of the locking member 53 can be prolonged.

In this embodiment, the pivot portion 531 of the locking member 53 extends through the carrier 51 and then is inserted movably into the elongate opening 521 so as to guide the sliding member 52 to move in a correct direction.

The retaining plate 54 is mounted to the carrier 51. The locking member 53 is mounted to the retaining plate 54. The retaining plate 54 is able to urge the locking portion 532 of the locking member 53 to extend into the guide groove 522 of the sliding member 52.

Figure 13:
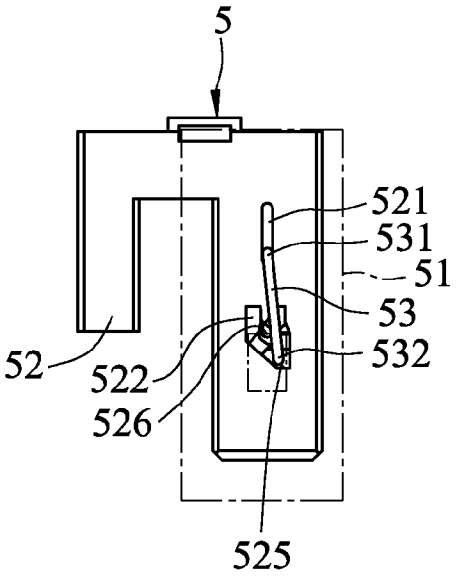
FIG. 13 is a side view illustrating the locking member of the switch control unit positioned in the first locking site of the guide groove in a sliding member.

Referring to FIGS. 5, 6 and 13, the switch unit 6 includes a spring-loaded module 61, a first conductive plate 62, a second conductive plate 63, a first contact member 64 and a second contact member 65. The spring-loaded module 61 is disposed in abutment with the sliding member 52. The first conductive plate 62 is disposed on the mount seat 2 and is constantly connected to the spring-loaded module 61. The second conductive plate 63 is disposed on the mount seat 2 and spaced apart from the first conductive plate 62. In this embodiment, the first and second conductive plates 62, 63 are respectively mounted to two opposite sides of the mount seat 2. The first contact member 64 is coupled to the mount seat 2. The second contact member 65 is disposed on the second conductive plate 63. In addition, the first contact member 64 is an insulator. The second contact member 65 is a conductor. However, the electrical characteristics of the first and second contact members 64, 65 should not be limited to this disclosure, and may be varied according to a desired electrical conducting mode.

One of the terminals 43 of the actuator 4 may be electrically connected to the first and second conductive plates 62, 63. In this embodiment, one of the terminals 43 is connected to the first conductive plate 62. As such, an electrical signal may be input to the other one of the terminals 43 to excite the magnetic spool 41 for the movements of the magnetic member 44.

Figure 15:
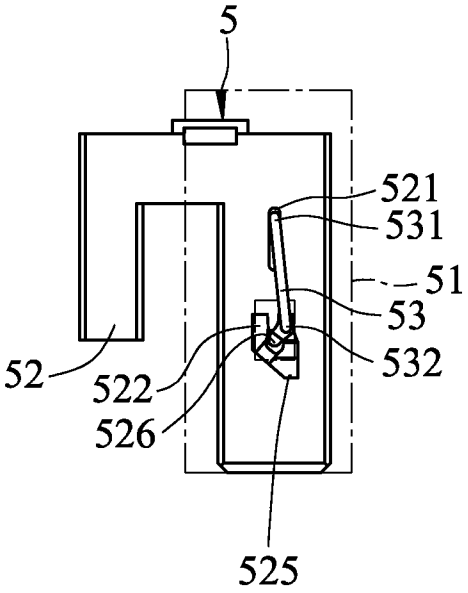
FIG. 15 is a side view illustrating the locking member in the second locking site.
Figure 14:
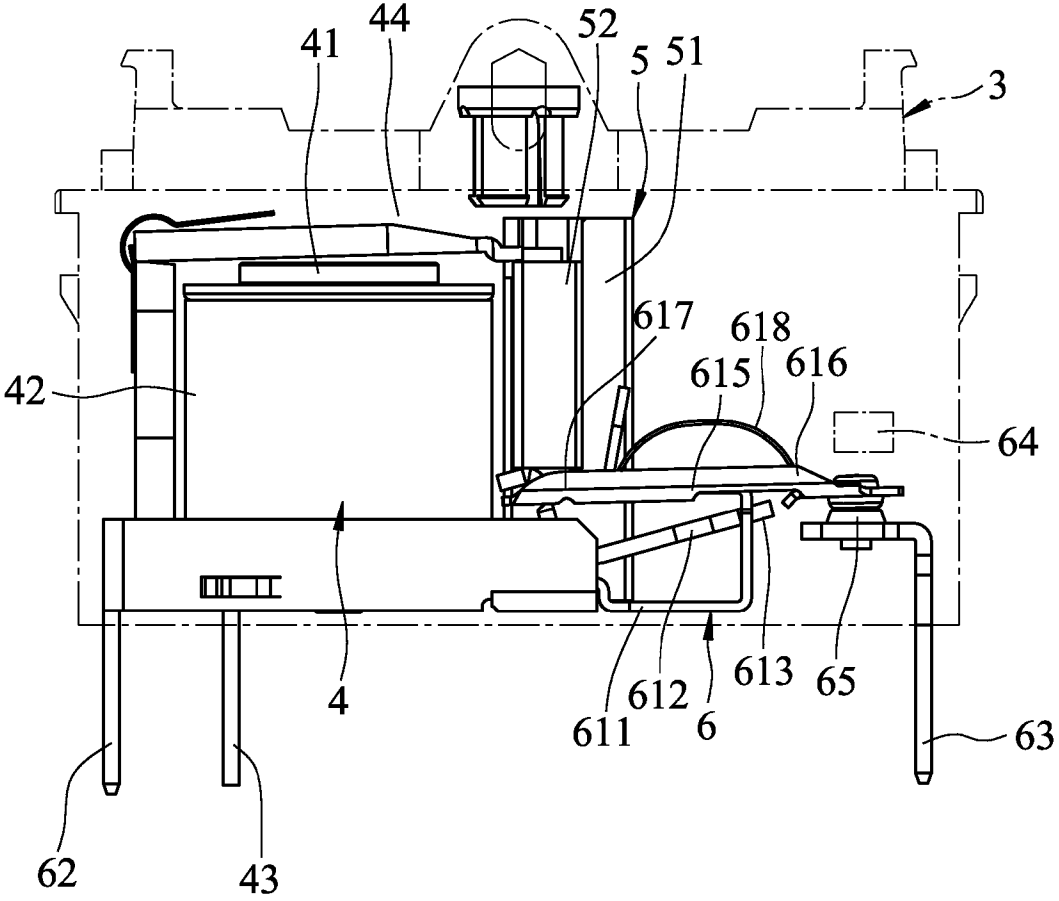
FIG. 14 is a side view of the embodiment illustrating the switch unit and the switch control unit when the locking member is in a second locking site.
Figure 17:
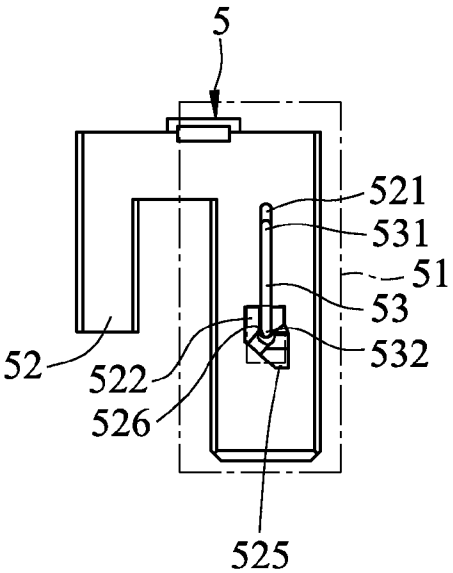
FIG. 17 is a side view illustrating the locking member at the position between the first and second locking sites.

When the coil 42 is electrified, since the magnetic spool 41 is excited to attract the magnetic member 44 of the actuator 4, the magnetic member 44 actuates the sliding member 52 to move relative to the carrier 51 between a first position (see FIGS. 12 and 13) and a second position (see FIGS. 14 and 15). As such, the sliding member 52 is moved by the magnetic member 44 to be positioned in one of the first and second positions. When the sliding member 52 is moved to the first position, the locking portion 532 of the locking member 53 is placed in the first locking site 525, and the spring-loaded module 61 urges the locking portion 532 to engage the first locking site 525, and at the same time moves away from the second conductive plate 63 so that the first and second conductive plates 62, 63 are electrically disconnected. As shown in FIGS. 14 and 15, when the sliding member 52 is moved to the second position by the actuator 4, the locking portion 532 of the locking member 53 is placed in the second locking site 526, and the spring-loaded module 61 urges the locking portion 532 to engage the second locking site 526, and at the same time moves to the second conductive plate 63 so that the first and second conductive plates 62, 63 are electrically connected with each other.

In this embodiment, the spring-loaded module 61 has a conductive substrate 611, an active plate 612, a passive plate 615 and a resilient plate 618.

The conductive substrate 611 is mounted to the mount seat 2 and is connected to the first conductive plate 62.

The active plate 612 has a connection portion 613 pivotally connected to the conductive substrate 611 and a force-transmitting portion 614 forcible by pushing of the sliding member 52.

The passive plate 615 is connected to the conductive substrate 611 and movable relative to the second conductive plate 63 when the sliding member 52 slides between the first and second positions. In this embodiment, the passive plate 615 has a contact portion 616 to contact one of the first and second contact members 64, 65, and a force-receiving portion 617 distal from the contact portion 616. The force-transmitting portion 614 is connected to the force-receiving portion 617 of the passive plate 615 and abuts with the sliding member 52. When the sliding member 52 is in the first position, the passive plate 615 moves away from the second conductive plate 63, and the contact portion 616 abuts against the first contact member 64, such that the first conductive plate 62 is electrically disconnected from the second conductive plate 63. When the sliding member 52 is in the second position, the passive plate 615 moves to the second conductive plate 63, and the contact portion 616 abuts against the second contact member 65, such that the first conductive plate 62 is electrically coupled to the second conductive plate 63.

The resilient plate 618 is connected between the conductive substrate 611 and the passive plate 615. When the sliding member 52 is in the first position, the resilient plate 618 urges the passive plate 615 to abut with the first contact member 64. When the sliding member 52 is in the second position, the resilient plate 618 urges the passive plate 615 to abut with the second contact member 65. In this embodiment, the resilient plate 618 is bent to form an arcuate shape and is a metal spring plate pre-compressed in assembly.

In this embodiment, each of the conductive substrate 611, the active plate 612 and the passive plate 615 is made from a metal material for transmitting an electrical current.

Figure 18:
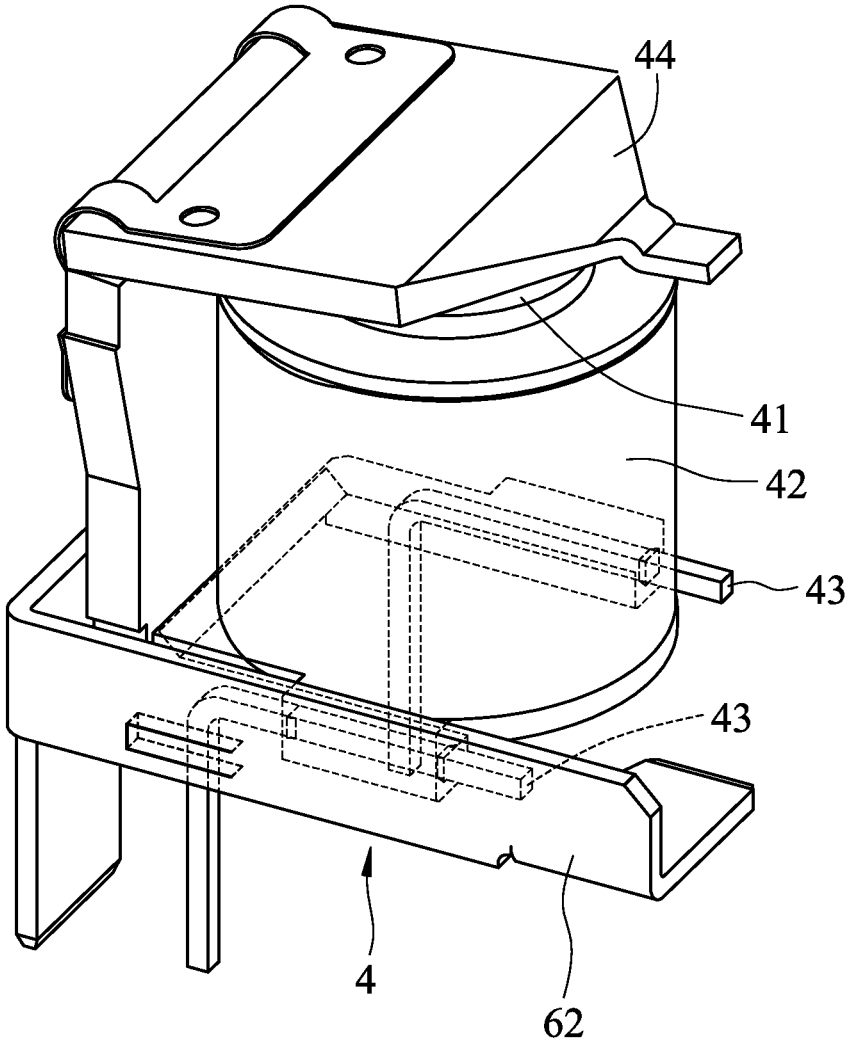
FIG. 18 is a perspective view illustrating the actuator and the first conductive plate, which are electrically disconnected from each other.

Referring to FIG. 18, the terminals 43 of the actuator 4 can be electrically disconnected from the first and second conductive plates 62, 63 of the switch unit 6. In this case, the switch assembly of this disclosure is an electromagnetic relay.

Figure 8:
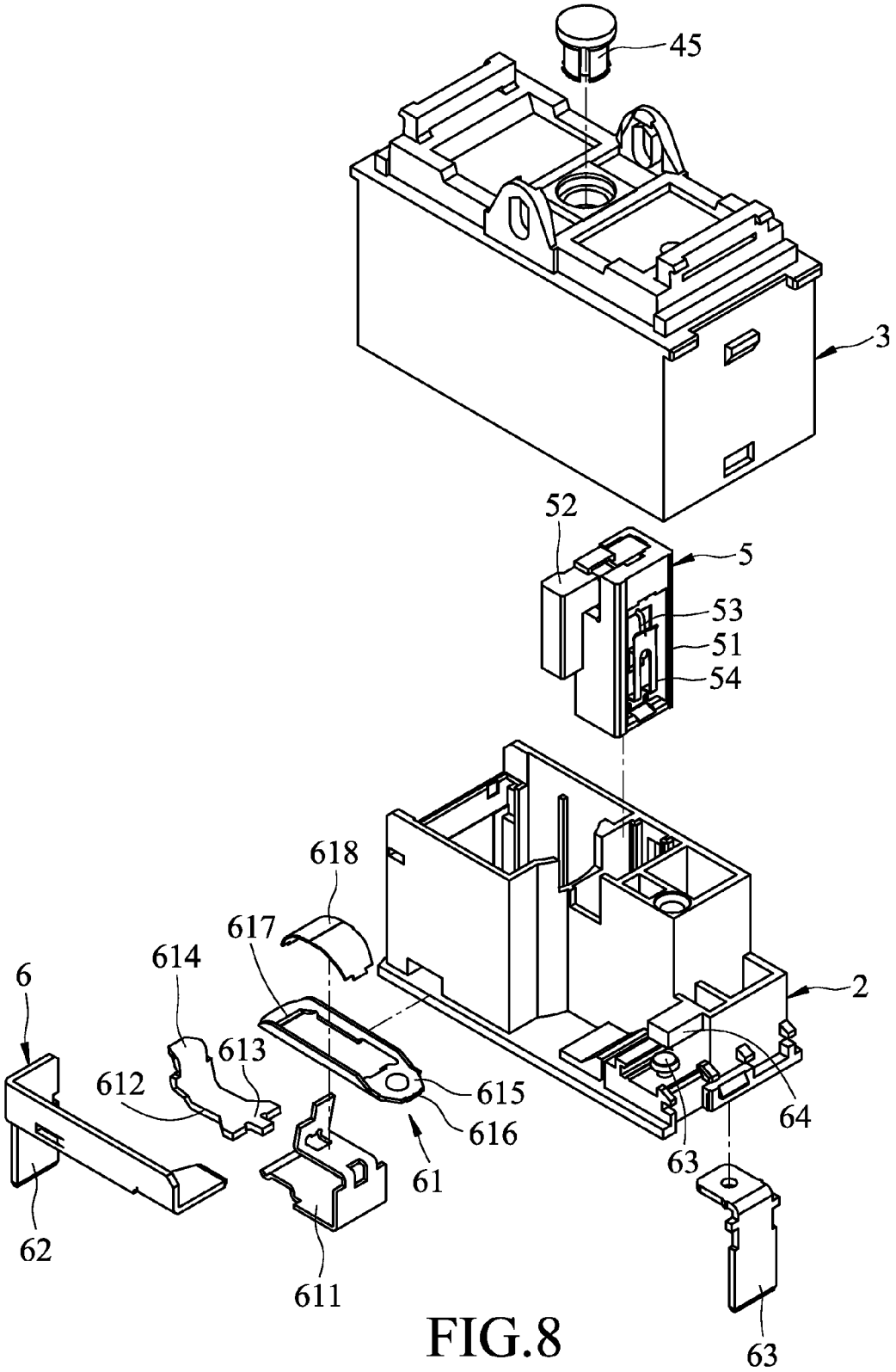
FIG. 8 is an exploded perspective view of another embodiment having only a press member used as the actuator.

Referring to FIG. 8, the magnetic spool 41, the coil 42, the terminals 43 and the magnetic member 44 may be dispensed with according to another embodiment of the disclosure. That is to say, the actuator 4 includes only the press member 45 for allowing the user to actuate the sliding member 52 for movement between the first and second positions.

To sum up, the switch assembly according to this disclosure has the following advantages:

1. Since the switch control unit 5 has a modularized design that can be detachably mounted to the mount seat 2, the switch control unit 5 can be assembled in advance to be mounted to the mount seat 2. Therefore, the switch control unit 5 may be conveniently pre-fabricated and the switch assembly may be assembled conveniently.

2. By cooperation of the guide groove 522 of the sliding member 52 and the locking portion 532 of the locking member 53, the sliding member 52 can be positioned in one of the first and second positions to lock the switch unit 6 in its electrically disconnected or connected state. Accordingly, even in a severe vibration environment, the switch assembly of the present disclosure is therefore safe to use.

3. The resilient plate 618 of the spring-loaded module 61 provides not only a pushing force to push upward the sliding member 52, but a biasing force to urge the passive plate 615 to move between the first and second contact members 64, 65. Therefore, extra assembly components may be dispensed with, and the switch assembly according to this embodiment may be reduced in volume and assembled easily.

4. In comparison of the electromagnetic relay assembly disclosed in the co-pending application, by virtue of the particular arrangement of the ramps and the steps of the sliding member 52, impaction between the guide groove 522 and the locking portion 532 of the locking member 53 is reduced, thereby prolonging the service life of the switch assembly.

Reference in the specification to "one embodiment" or "an embodiment" means that a particular feature, structure, or characteristic described in connection with the embodiment may be included in at least an implementation. The appearances of the phrase "in one embodiment" in various places in the specification may or may not be all referring to the same embodiment. Various features, aspects, and an exemplary embodiment have been described herein. The features, aspects, and the exemplary embodiment are susceptible to combination with one another as well as to variation and modification, as will be understood by those having skill in the art.

This disclosure is not limited to the disclosed exemplary embodiment but is intended to cover various arrangements included within the spirit and scope of the broadest interpretation so as to encompass all such modifications and equivalent arrangements.

What is claimed is:

1. A switch assembly comprising:

a housing;

an actuator mounted to said housing;

a switch control unit including a carrier that is mounted on said housing in proximity to said actuator, a sliding member that is slidably inserted into said carrier and actuated by said actuator, said sliding member having a guide groove that forms a closed cycle path and that has a first locking site, a second locking site, a plurality of ramps, and a plurality of steps, said first locking site being situated between one of said steps and one of said ramps adjacent to said one of said steps, said second locking site being situated between another one of said steps and another one of said ramps adjacent to said another one of said steps, and a locking member that has a pivot portion which is pivotally connected to said carrier, and a locking portion which is inserted into said guide groove and which is movable relative to said closed cycle path to displace between said first and second locking sites; and a switch unit including a spring-loaded module that is disposed in abutment with said sliding member, a first conductive plate that is connected to said spring-loaded module, and a second conductive plate that is spaced apart from said first conductive plate, wherein said actuator actuates said sliding member to move relative to said carrier between a first position and a second position, wherein, when said sliding member is moved to said first position, said locking portion of said locking member is placed in said first locking site and said spring-loaded module urges said locking portion to engage said first locking site, and at the same time moves away from said second conductive plate so that said first and second conductive plates are electrically disconnected, and wherein, when said sliding member is moved to said second position, said locking portion of said locking member is placed in said second locking site, and said spring-loaded module urges said locking portion to engage said second locking site, and at the same time moves to said second conductive plate so that said first and second conductive plates are electrically connected with each other.

2. The switch assembly as claimed in claim 1, wherein said carrier of said switch control unit is detachably mounted on said housing.

3. The switch assembly as claimed in claim 2, wherein said switch control unit further includes a retaining plate that is mounted to said carrier, said locking member is mounted to said retaining plate, said retaining plate being able to urge said locking portion of said locking member to extend into said guide groove of said sliding member.

4. The switch assembly as claimed in claim 2, wherein said sliding member further has an elongate opening that is spaced apart from said guide groove, said pivot portion of said locking member being inserted movably into said elongate opening.

5. The switch assembly as claimed in claim 1, wherein said guide groove has a profile substantially conforming to a heart shape, said first and second locking sites being aligned with each other along an axis of symmetry of said guide groove.

6. The switch assembly as claimed in claim 1, wherein said locking portion of said locking member slides cyclically on said closed cycle path of said guide groove along a single angular direction from said first locking site to said second locking site and from said second locking site to said first locking site, said locking portion consecutively passing through a first one of said ramps, a first one of said steps, and a second one of said steps when sliding from said first locking site to said second locking site, and passing through a second one 5232 of said ramps, a third one of said steps, a third one of said ramps, and a fourth one of said steps when sliding from said second locking site to said first locking site.

7. The switch assembly as claimed in claim 1, wherein said first and second locking sites are equal in depth and are as deep as a bottom end of said guide groove.

8. The switch assembly as claimed in claim 7, wherein a height of each of said steps is 0.2 millimeters along a direction of a depth of said guide groove.

9. The switch assembly as claimed in claim 1, wherein said spring-loaded module has a conductive substrate mounted to said housing and connected to said first conductive plate, and a passive plate connected to said conductive substrate;

wherein, when said sliding member is in said first position, said passive plate moves away from said second conductive plate, such that said first conductive plate is electrically disconnected from said second conductive plate; and wherein, when said sliding member is in said second position, said passive plate moves to said second conductive plate, such that said first conductive plate is electrically coupled to said second conductive plate.

10. The switch assembly as claimed in claim 9, wherein said passive plate has a contact portion to contact said second conductive plate, and a force-receiving portion distal from said contact portion, said spring-loaded module further having an active plate that has a connection portion pivotally connected to said conductive substrate, and a force-transmitting portion connected to said force-receiving portion of said passive plate and abutting with said sliding member.

11. The switch assembly as claimed in claim 10, wherein said spring-loaded module further has a resilient plate connected between said conductive substrate and said passive plate.

12. The switch assembly as claimed in claim 1, wherein:

said actuator includes a magnetic spool, a coil wound on said magnetic spool, and a magnetic member confronting with said magnetic spool; and when said coil is electrified to activate and enable said magnetic spool to attract said magnetic member, said sliding member is moved by said magnetic member to be positioned in one of said first and second positions.

13. The switch assembly as claimed in claim 12, wherein said actuator further includes two terminals electrically coupled to the coil for receiving a current signal.

14. The switch assembly as claimed in claim 13, wherein one of said terminals is electrically connected to one of said first and second conductive plates.

15. The switch assembly as claimed in claim 1, wherein said actuator includes a press member disposed on said housing to actuate said sliding member.

* * * * *